US012090384B2

(12) United States Patent
Lewis

(10) Patent No.: US 12,090,384 B2
(45) Date of Patent: Sep. 17, 2024

(54) SPORTING EQUIPMENT STORAGE SLING

(71) Applicant: Ryan Lewis, Nedrow, NY (US)

(72) Inventor: Ryan Lewis, Nedrow, NY (US)

( * ) Notice: Subject to any disclaimer, the term of this patent is extended or adjusted under 35 U.S.C. 154(b) by 0 days.

(21) Appl. No.: 17/573,908

(22) Filed: Jan. 12, 2022

(65) Prior Publication Data

US 2022/0219061 A1 Jul. 14, 2022

Related U.S. Application Data

(60) Provisional application No. 63/136,271, filed on Jan. 12, 2021.

(51) Int. Cl.

| | |
|---|---|
| ***A45F 3/14*** | (2006.01) |
| ***A63B 71/00*** | (2006.01) |
| *A63B 102/14* | (2015.01) |
| *A63B 102/24* | (2015.01) |

(52) U.S. Cl.

CPC ..... *A63B 71/0036* (2013.01); *A45F 3/14* (2013.01); *A45F 2003/142* (2013.01); *A63B 2102/14* (2015.10); *A63B 2102/24* (2015.10)

(58) Field of Classification Search

CPC ..... A63B 71/0036; A45F 3/14
USPC ..... 224/607
See application file for complete search history.

(56) References Cited

U.S. PATENT DOCUMENTS 4,466,124 A * 8/1984 Kirkham, Jr. ..... A45F 3/04 224/153
4,558,807 A * 12/1985 Jackson ..... A45B 25/24 224/258
4,746,159 A * 5/1988 Webb ..... A63C 11/027 D3/261
4,792,073 A * 12/1988 Jacober ..... A63C 11/025 D3/261
4,804,025 A * 2/1989 Bear ..... A45F 3/14 224/264
D316,631 S * 5/1991 Hammons ..... D3/257
5,018,609 A * 5/1991 Brenner ..... A45C 3/00 190/110
5,139,187 A * 8/1992 Fowler ..... A41D 15/04 D2/611
5,429,075 A * 7/1995 Passarella ..... F21V 33/008 224/251
5,433,288 A * 7/1995 James ..... A62C 33/04 224/250
5,433,502 A * 7/1995 Condorodis ..... A47C 4/03 297/45
D381,805 S * 8/1997 Case ..... D3/229
(Continued)

*Primary Examiner* — Nathan J Newhouse
*Assistant Examiner* — Lester L Vanterpool
(74) *Attorney, Agent, or Firm* — Boudwin Intellectual Property Law, LLC; Daniel Boudwin

(57) ABSTRACT

A sporting equipment storage sling is provided. The device includes a tubular housing having an open first end opposite an open second end. An adjustable strap is affixed to the tubular housing at each of the first and second ends. A plurality of fasteners disposed along a length of the tubular housing opposite the adjustable strap. The plurality of fasteners removably secure sporting equipment to the tubular housing, such that the user can easily transport and dry sporting equipment between uses. In some embodiments, a bag is affixed to the tubular housing, wherein the bag includes an opening through an upper end thereof.

4 Claims, 4 Drawing Sheets

(56) References Cited

U.S. PATENT DOCUMENTS 5,775,495 A * 7/1998 Lang ..... A45C 3/14 190/102
5,829,656 A * 11/1998 Reitz ..... B62J 11/00 294/154
6,176,403 B1 1/2001 Svare et al.
D447,629 S * 9/2001 Gardner ..... D3/254
D450,919 S * 11/2001 Lee ..... D3/11
D470,308 S * 2/2003 McGeehan ..... D3/228
6,550,653 B2 * 4/2003 Matthews ..... A45F 3/14 224/264
6,575,513 B2 6/2003 Pikel
6,659,316 B2 12/2003 Fleming et al.
6,923,356 B2 * 8/2005 Reynolds ..... B60R 7/043 224/604
D525,786 S * 8/2006 Orlando ..... D3/269
7,083,331 B2 * 8/2006 Nykoluk ..... A45C 3/00 383/2
7,111,730 B1 * 9/2006 Alas ..... A63B 60/60 206/315.1
D551,862 S * 10/2007 Gerry ..... D3/300
D688,042 S * 8/2013 King ..... D3/276
9,756,920 B2 * 9/2017 Spears ..... A45F 3/047
9,872,579 B2 * 1/2018 Flynn ..... F16B 45/023
D985,928 S * 5/2023 Wang ..... D21/839
2006/0228051 A1 * 10/2006 Yu ..... A45C 7/0077 224/153
2009/0266860 A1 * 10/2009 Schneider Barterian ..... A45F 3/042 224/236
2010/0044404 A1 2/2010 Guy
2010/0089959 A1 * 4/2010 Watson ..... A45C 13/30 224/580
2012/0177306 A1 * 7/2012 DeHart ..... A01D 43/0636 383/22
2012/0255879 A1 * 10/2012 Gillespie ..... A63B 60/56 220/254.1
2014/0339275 A1 11/2014 Krikorian
2018/0139944 A1 * 5/2018 River ..... A45F 3/02

* cited by examiner

SPORTING EQUIPMENT STORAGE SLING

CROSS REFERENCE TO RELATED APPLICATIONS

This application claims the benefit of U.S. Provisional Application No. 63/136,271 filed on Jan. 12, 2021. The above identified patent application is herein incorporated by reference in its entirety to provide continuity of disclosure.

BACKGROUND OF THE INVENTION

The present invention relates to sporting equipment storage and transport systems. More particularly, the present invention pertains to a sporting equipment sling capable of simultaneously carrying protective gear and accessories required for a desired sport.

Many individuals enjoy playing sports, either competitively or for recreation, however these sports often require an individual to use several pieces of equipment or accessories. Transporting this equipment can be cumbersome and often requires multiple trips or bulky bags. For example, when playing lacrosse, an individual must utilize a lacrosse stick, helmet, gloves, various pads, and a chest protector. Traditionally, in order to transport these items, a large duffel bag is utilized, and the equipment is piled in haphazardly, or when using smaller containers, forcibly placed within, risking damage to the equipment. Additionally, typical carrying bags aren't sufficiently breathable, allowing bacteria or fungus to grow on recently used equipment covered in sweat. This can lead to undesirable odors or unpleasant experiences for the user when the equipment is next used. In order to address this, air-drying the equipment before storage is often desirable, however, waiting for equipment to air dry before storing and transporting equipment is time-consuming and inefficient. Additionally, sports equipment can be troublesome to wash properly as they must often be washed separately and with specific instructions, requiring the user to spend several wash cycles to clean the entire set. Therefore, a storage and transport system that can allow the equipment to air dry to minimize the risk of odors and bacterial growth, while also increasing transport efficiency is desired.

In light of the devices disclosed in the known art, it is submitted that the present invention substantially diverges in design elements from the known art and consequently it is clear that there is a need in the art for an improvement to existing sporting equipment storage and transport systems. In this regard, the instant invention substantially fulfills these needs.

SUMMARY OF THE INVENTION

In view of the foregoing disadvantages inherent in the known types of sporting equipment storage and transport systems now present in the known art, the present invention provides a sporting equipment storage sling wherein the same can be utilized for providing convenience for the user when transporting and air-drying protective gear, accessories, and other sporting equipment between uses.

The present system comprises a tubular housing having an open first end opposite an open second end. An adjustable strap is affixed to the tubular housing at each of the first and second ends. A plurality of fasteners are disposed along a length of the tubular housing opposite the adjustable strap, wherein the plurality of fasteners are configured to removably secure sporting equipment to the tubular housing. In some embodiments, a bag is affixed to the tubular housing, wherein the bag comprises an opening through an upper end thereof, wherein the opening is oriented towards the open first end of the tubular housing.

In some embodiments, a diameter of each of the first end and the second end is greater than a diameter of a central portion of the tubular housing. In another embodiment, the adjustable strap further comprises a securement fastener disposed on a terminal end thereof, wherein the securement fastener is configured to selectively disengage the terminal end of the adjustable strap from the tubular housing. In other embodiments, the adjustable strap comprises a buckle thereon, wherein the buckle is configured to selectively adjust a length of the adjustable strap. In yet another embodiment, the plurality of fasteners comprise carabiners having a spring biased latch pivotally affixed to a fastener body. In some embodiments, a plurality of eyelets is affixed to the exterior of the tubular housing, wherein a fastener of the plurality of fasteners is secured to each of the plurality of eyelets. In another embodiment, an aperture of each of the plurality of eyelets is coaxially aligned. In other embodiments, the plurality of fasteners are disposed at regular intervals along the tubular housing. In yet another embodiment, the bag is removably securable to the tubular housing via securement straps affixed to a lateral edge of the bag adjacent to the upper end and a lower end of the bag. In some embodiments, the securement straps comprise a first portion removably securable to a second portion via complementary fasteners. In another embodiment, a drawstring is disposed through the upper end of the bag about the opening, wherein the drawstring is configured to selectively move the opening between an open configuration and a closed configuration. In other embodiments, the bag comprises a material permeable to air.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
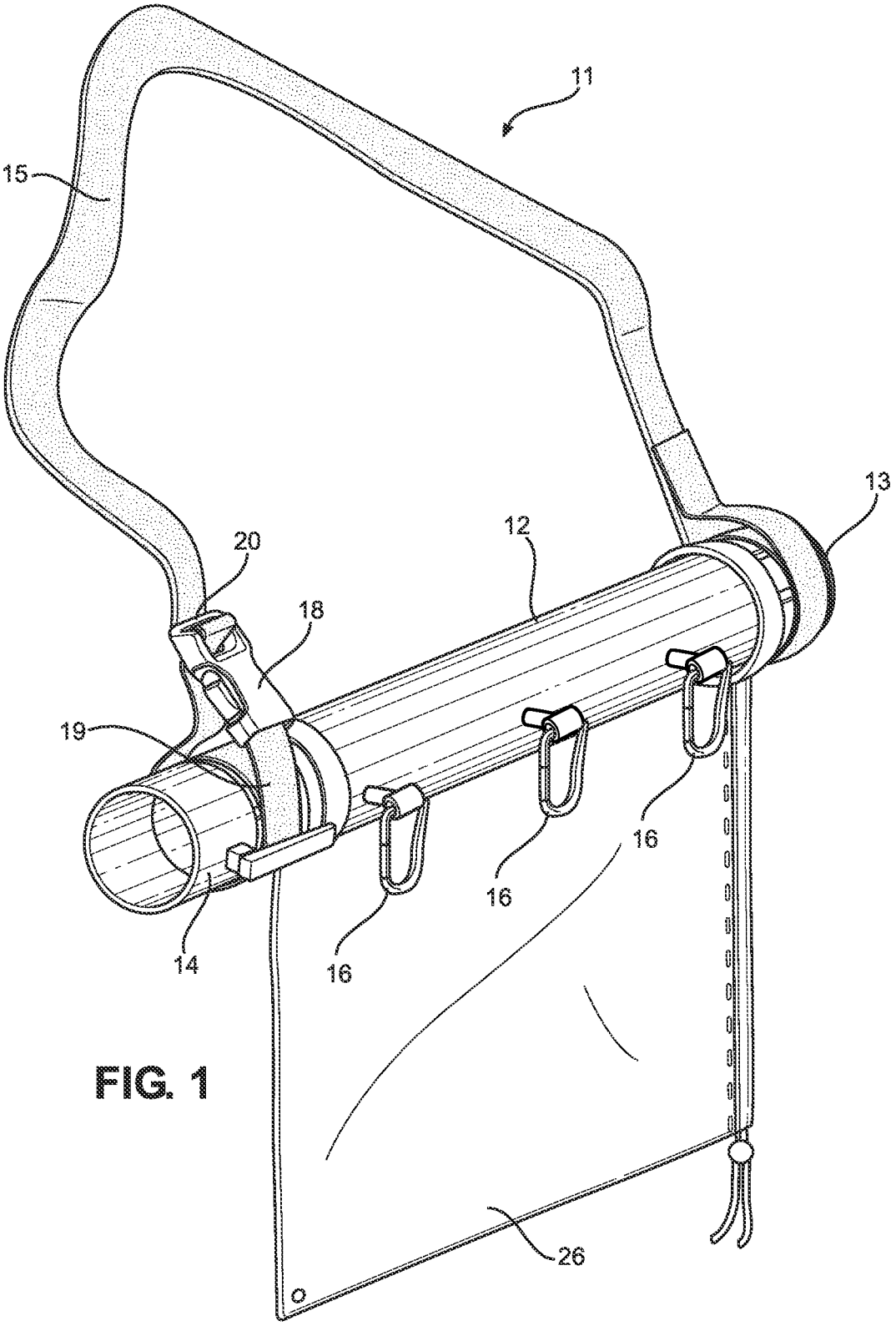
FIG. 1 shows a perspective view of an embodiment of the sporting equipment storage sling.

Reference is made herein to the attached drawings. Like reference numerals are used throughout the drawings to depict like or similar elements of the sporting equipment storage sling. The figures are intended for representative purposes only and should not be considered to be limiting in any respect.

Figure 4:
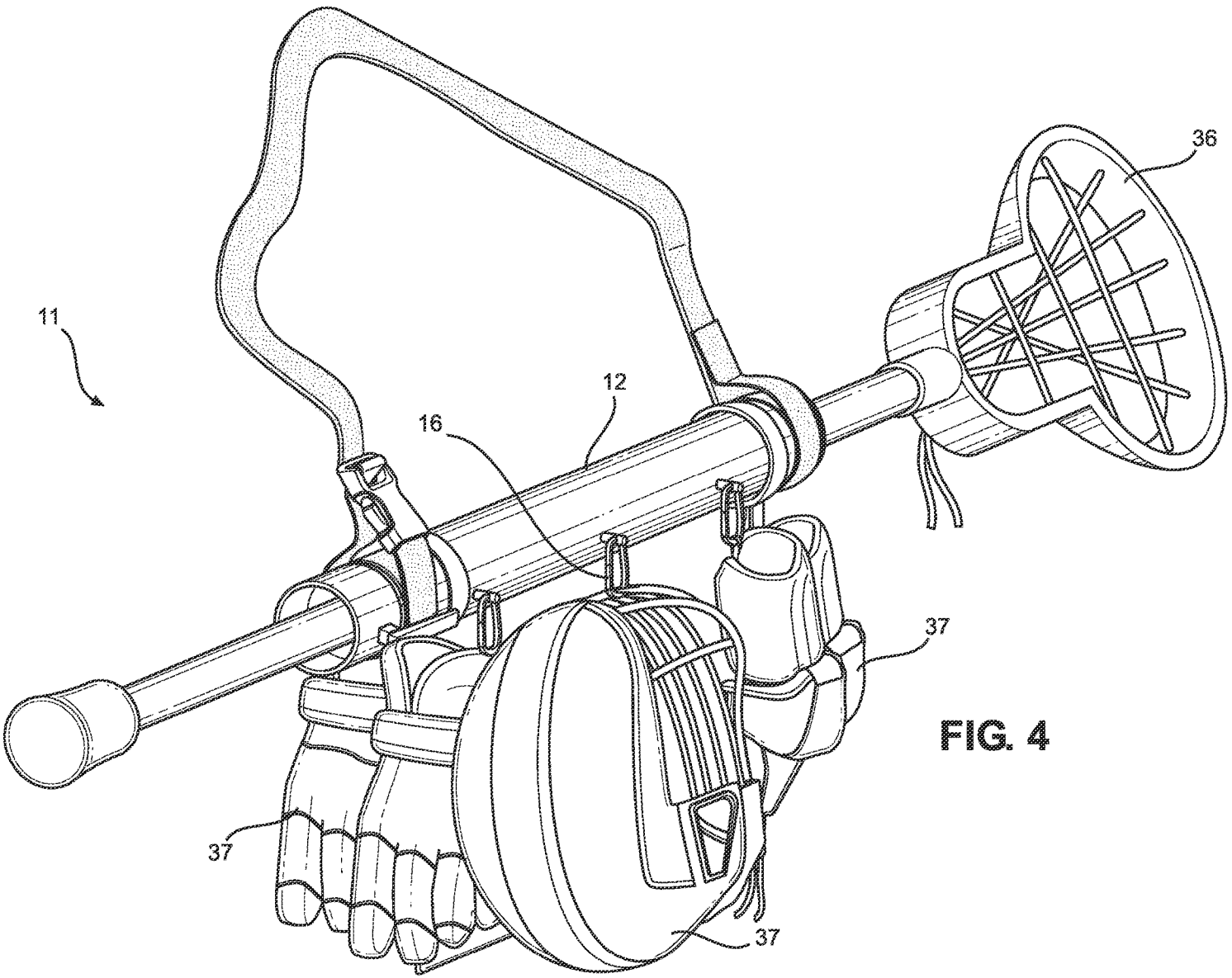
FIG. 4 shows a perspective view of an embodiment of the sporting equipment storage sling in use.

Referring now to FIG. 1, there is shown a perspective view of an embodiment of the sporting equipment storage sling. The sporting equipment storage sling 11 comprises a tubular housing 12 having an open first end 13 opposite an open second end 14 defining a channel therethrough, wherein the channel is dimensioned to receive an elongated object, such as a lacrosse stick (as shown in FIG. 4, 36), hockey stick, or the like therethrough. The tubular housing 12 comprises a rigid material configured to maintain its shape to protect the object within the tubular housing 12 from impacts thereto. An adjustable strap 15 is affixed to the first end 13 and the second end 14 of the tubular housing 12, wherein the adjustable strap 15 is configured to provide a carrying strap, such that the tubular housing 12 can be slung over a user's shoulder for efficient simultaneous transport of several pieces of sporting equipment. In the shown embodiment, the adjustable strap 15 comprises a closed loop on opposing ends thereof, wherein the closed loops are dimensioned to secure about the tubular housing 12. In some embodiments, the closed loops are stitched to the adjustable strap 15 to permanently affix the adjustable strap 15 to the tubular housing 12, however, in alternate embodiments, the closed loops are further contemplated to be removably securable about the tubular housing 12, such that the adjustable strap 15 may be removed therefrom for storage when not in use. In some embodiments, a securement fastener 18 is disposed on a distal end 19 of the adjustable strap 15, wherein the securement fastener 18 is configured to selectively disengage the distal end 19 of the adjustable strap from the closed loop disposed about the tubular housing 12. In this manner, the user can quickly disconnect the adjustable strap 15 from the tubular housing 12 at one end thereof, such that the tubular housing 12 can be removed from the user. In the shown embodiment, the securement fastener 18 comprises a male and female fastener system, wherein the male fastener is removably securable within the female fastener, whereupon prongs of the male fastener secure within openings of the female fastener via frictional engagement to secure the male fastener to the female fastener. Furthermore, in the illustrated embodiment, a buckle 20 is disposed on the adjustable strap 15, wherein the buckle 20 is configured to selectively adjust a length of the adjustable strap 15 as desired to fit users of various sizes. In the shown embodiment, the buckle 20 is integrally affixed to an end of the securement fastener 18. In the shown embodiment, an L-shaped attachment is affixed to the second end 14 of the tubular housing 12, wherein the L-shaped attachment prevents the adjustable strap 15 from sliding from the tubular housing 12 when secured over the user's shoulder. Similarly, the first end 13 is contemplated to include an L-shaped attachment facing in an opposite direction to facilitate the usage of the sporting equipment storage sling 11 in an inverted position, wherein the first end 13 is disposed closer to the user's feet in use.

A plurality of fasteners 16 are disposed along a length of the tubular housing 12 directly opposite the adjustable strap 15, such that objects secured to the plurality of fasteners 16 hang freely from the tubular housing 12 when the adjustable strap 15 is secured over the user's shoulder. In the illustrated embodiment, the plurality of fasteners 16 comprise carabiners, however, alternate securement means capable of removably securing various sporting equipment to the tubular housing 12 are contemplated. In some embodiments, the plurality of fasteners 16 are integrally affixed to the tubular housing 12, whereas, in other embodiments, the plurality of fasteners 16 are removably securable to the tubular housing 12 to minimize the weight of the sporting equipment storage sling 11 when the plurality of fasteners 16 are unnecessary. Furthermore, in the illustrated embodiment, a bag 26 is affixed to the tubular housing 12, wherein the bag 26 is dimensioned to store various sporting equipment accessories therein. In some embodiments, the bag 26 is permanently affixed to the tubular housing 12, however, in the shown embodiments, the bag 26 is removably securable to the tubular housing 12, such that the user can remove the bag 26 when desired. The bag 26 is contemplated to comprise a material permeable to air such that the sporting equipment accessories are properly ventilated to dry sweat and prevent the accumulation of bacteria therein. In this manner, the sporting equipment accessories can be more efficiently maintained and reduce the risk of exposure to bacteria or fungus for the user. In some embodiments, the bag 26 comprises a mesh material having a plurality of openings therethrough, wherein the mesh material increases ventilation of the interior volume of the bag 26 to facilitate drying of the objects therein.

Figure 2:
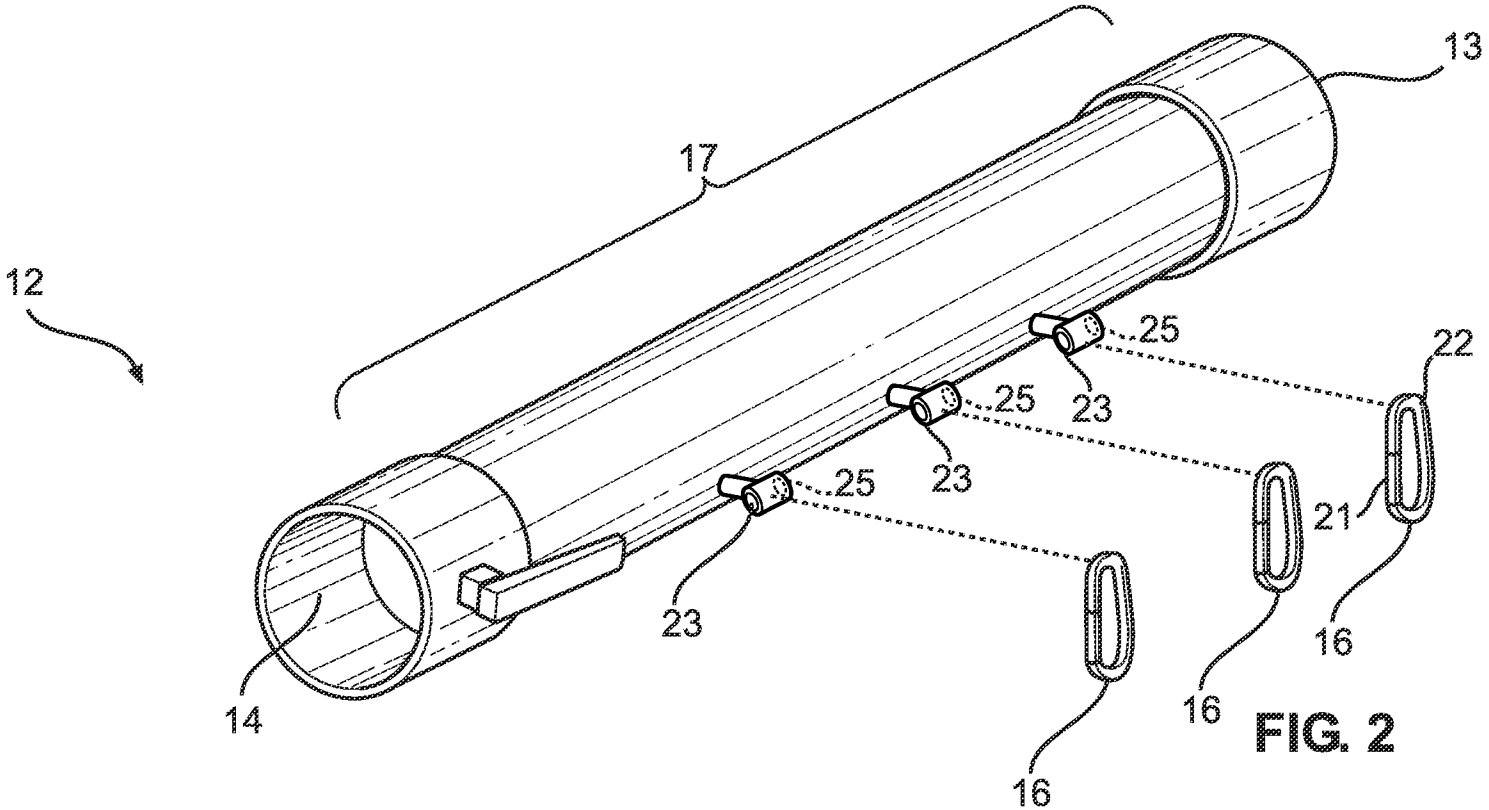
FIG. 2 shows an exploded view of the tubular housing and plurality of fasteners of an embodiment of the sporting equipment storage sling.

Referring now to FIG. 2, there is shown an exploded view of the tubular housing and plurality of fasteners of an embodiment of the sporting equipment storage sling. In the illustrated embodiment, the open first end 13 and the open second end 14 comprise a larger diameter than a central portion 17 of the tubular housing 12. In this manner, the larger open ends facilitate efficient and simple insertion of the elongated object into the tubular housing 12 while the sporting equipment storage sling 11 is slung over the user's shoulder. In such embodiments, the open first end 13 and the open second end 14 are further contemplated to have a diameter less than a head of the elongated object, such as the basket of a lacrosse stick or the curved head of a hockey stick, for example. In this manner, the elongated object is retained within the tubular housing 12 via the head resting against one of the open first or second ends 13, 14.

In the illustrated embodiment, a plurality of eyelets 23 are disposed linearly along a length of the central portion 17 of the tubular housing 12. In the shown embodiment, the plurality of eyelets 23 is regularly disposed along the length of the tubular housing 12, such that equipment secured thereto via the plurality of fasteners 16 is evenly disposed along the length of the tubular housing 12 to distribute weight and prevent excessive damage due to jostling during transport. The plurality of eyelets 23 include an aperture 25 therethrough, wherein a fastener of the plurality of fasteners 16 is removably securable through the apertures 25 of an eyelet of the plurality of eyelets 23. In some embodiments, the plurality of eyelets 23 comprise a stem extending from the tubular housing 12 having a head on a distal end of the stem, wherein the head includes the aperture 25 therethrough. In this manner, the plurality of fasteners 16 are maintained at a distance from the tubular housing 12 to prevent sporting equipment affixed to the plurality of fasteners 16 from being damaged from constant contact against the tubular housing 12 during transport. In the shown embodiment, the apertures 25 of each of the plurality of eyelets 23 are coaxially aligned. In the illustrated embodiment, the plurality of fasteners 16 comprise a fastener body 22 having a spring-biased latch 21 pivotally affixed thereto, wherein the spring-biased latch 21 is configured to selectively move between an open position and a closed position and is further biased towards the closed position. When in the closed position, the spring-biased latch 21 is configured to rest coaxially with the fastener body 22, such that an object is retained within the fastener body 22. The plurality of fasteners 16 may include a D-shaped carabiner 16A, which is the strongest type of carabiner and provides the relatively greatest amount of safety compared to other shaped carabiner.

Figure 3:
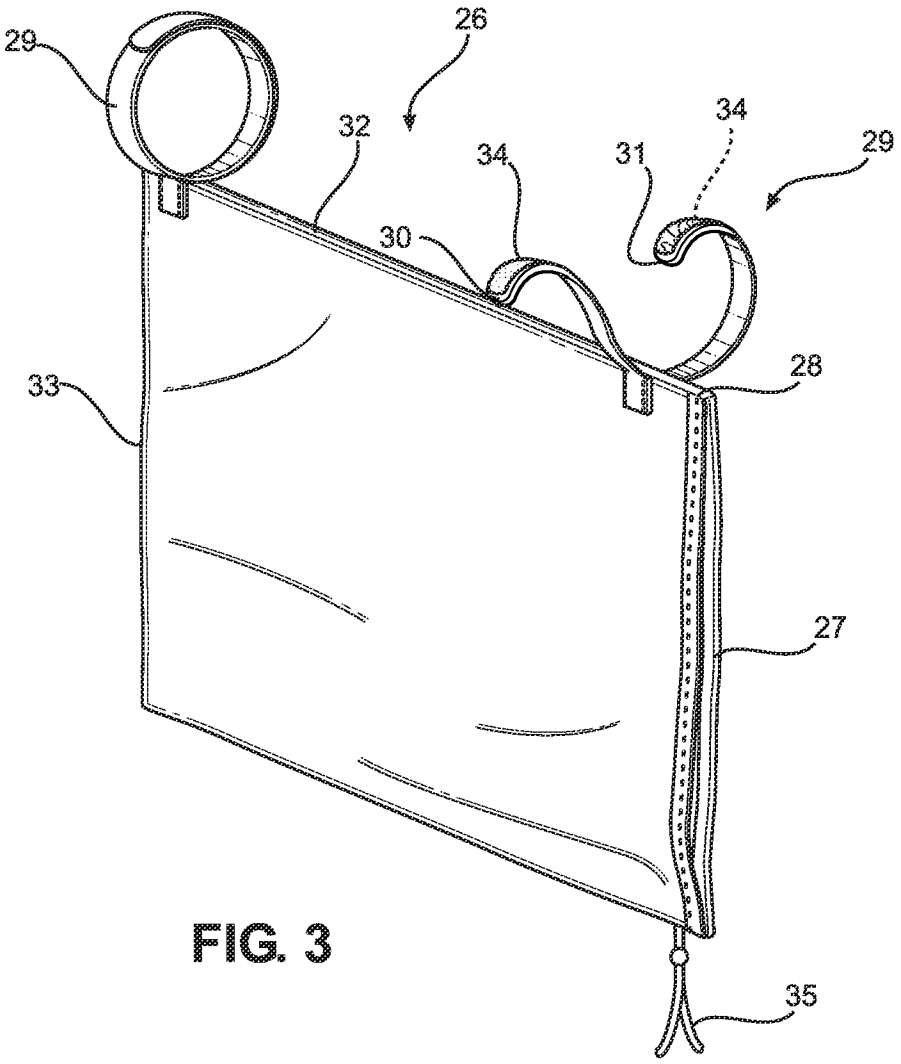
FIG. 3 shows a perspective view of the bag of an embodiment of the sporting equipment storage sling.

Referring now to FIG. 3, there is shown a perspective view of the bag of an embodiment of the sporting equipment storage sling. In the illustrated embodiment, the bag 26 comprises an opening 27 disposed through an upper end 28 of the bag 26, a pair of closed lateral edges 32, and a closed lower end 33 opposite the upper end 28. The opening 27 provides access to an interior volume of the bag 26, such that various sporting equipment accessories can be stored therein. In the illustrated embodiment, the opening 27 is selectively closable via a drawstring 35 closure disposed through the upper end 28 of the bag 26. In some embodiments, the drawstring 35 comprises a spring-biased toggle thereon, wherein the spring-biased toggle is configured to retain the upper end 28 in a closed configuration. In alternate embodiments, the opening 27 is selectively closable via alternate closure means, such as, but not limited to hook and loop fasteners disposed along an interior surface of the bag 26 along the upper end 28 thereof, a zipper mechanism, buttons, snaps, or other fasteners. In this manner, the user can ensure that sporting equipment accessories are maintained within the interior volume of the bag 26.

In the shown embodiment, a pair of securement straps 29 are disposed on one lateral edge 32 of the bag 26, wherein the pair of securement straps 29 are configured to removably secure the bag 26 to the tubular housing. In the shown embodiment, each securement strap of the pair of securement straps 29 comprises a first portion 30 and a second portion 31, wherein the first portion 30 is removably securable to the second portion 31 via a pair of complementary fasteners 34 disposed thereon. In the shown embodiment, the complementary fasteners 34 are disposed on opposing surfaces of the first and second portion 30, 31, such as an interior surface of the first portion 30 and an exterior surface of the second portion 31. In this manner, the first and second portions 30, 31 can be placed flush about an exterior surface of the tubular housing and secured together via the complementary fasteners 34 to affix the bag 26 to the tubular housing. In some embodiments, the complementary fasteners 34 comprise hook and loop fasteners, wherein the first portion 30 comprises a hook fastener and the second portion 31 comprises a loop fastener, or vice versa. In this manner, the user can readily remove the bag 26 from the tubular housing when desired.

Referring now to FIG. 4, there is shown a perspective view of an embodiment of the sporting equipment storage sling in use. In one use, the user can affix the plurality of fasteners 16 to the tubular housing 12 via the plurality of eyelets and secure the bag to the tubular housing 12 via the securement straps. Once secured, the user can place various sporting equipment accessories, such as tape, additional clothing, towels, repair supplies for the sporting equipment, or the like. An elongated object, such as the lacrosse stick 36, can be inserted through the tubular housing, such that the head of the lacrosse stick 36 rests against the first end of the tubular housing. In this manner, the head of the lacrosse stick 36 is retained within the tubular housing during transport. Various other pieces of sporting equipment 37 can then be secured to the plurality of fasteners 16, such as helmets, gloves, pads, or the like. Once the desired sporting equipment 36, 37 is secured to the sporting equipment storage sling 11, the user can secure the sling 11 over their shoulder via the adjustable strap. The length of the adjustable strap can then be selectively adjusted to ensure the tubular housing 12 rests comfortably along the user's back during transport. In this manner, the user can easily transport and store various sporting equipment, while maximizing airflow thereacross, thereby reducing the rate at which bacteria and fungus develop on sweat covered sporting equipment after use.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A sporting equipment storage sling, comprising:

a horizontal tubular housing having an open first end opposite an open second end;

an adjustable strap affixed to the horizontal tubular housing at each of the first and second ends; and a plurality of fasteners disposed along a length of the horizontal tubular housing opposite the adjustable strap;

wherein the plurality of fasteners are configured to removably secure a piece of sporting equipment to the horizontal tubular housing;

wherein the horizontal tubular housing defines a channel that is dimensioned to receive the piece of sporting equipment that is an elongated object;

wherein a diameter of each of the first end and the second end of the horizontal tubular housing is greater than a diameter of a central portion of the horizontal tubular housing;

wherein the plurality of fasteners each having a D-shaped carabiner with a spring biased latch pivotally affixed to a fastener body;

further comprising a plurality of eyelets affixed to the exterior of the horizontal tubular housing;

wherein a fastener of each of the plurality of fasteners is secured to each of the plurality of eyelets;

wherein an aperture of each of the plurality of eyelets is coaxially aligned;

wherein the horizontal tubular housing includes a rigid material configured to maintain its shape to protect the object within the tubular housing from impact;

wherein the plurality of fasteners are disposed along a length of the tubular housing directly opposite the adjustable strap, such that objects secured to the plurality of fasteners hang freely from the tubular housing when the adjustable strap is secured over a user's shoulder;

wherein the adjustable strap further comprises a securement fastener disposed on a terminal end thereof;

wherein the securement fastener is configured to selectively disengage the terminal end of the adjustable strap from the tubular housing;

wherein a plurality of additional pieces of sporting equipment are secured to the plurality of fasteners; and wherein the securement fastener is configured to selectively disengage a distal end of the adjustable strap from the closed loop disposed about the tubular housing.

2. The sporting equipment storage sling of claim 1, wherein the adjustable strap comprises a buckle to selectively adjust a length of the adjustable strap.

3. The sporting equipment storage sling of claim 1, wherein the plurality of fasteners are disposed at regular intervals along the tubular housing.

4. A sporting equipment storage sling, consisting of:

a tubular housing having an open first end opposite an open second end;

an adjustable strap affixed to the tubular housing at each of the first and second ends;

a plurality of fasteners disposed along a length of the tubular housing opposite the adjustable strap;

wherein the plurality of fasteners are configured to removably secure a piece of sporting equipment to the tubular housing;

a bag affixed to the tubular housing;

wherein the bag comprises an opening through an upper end thereof;

wherein the opening is oriented towards the open first end of the tubular housing;

wherein the tubular housing defines a channel that is dimensioned to receive the piece of sporting equipment that is an elongated object;

wherein a diameter of each of the first end and the second end is greater than a diameter of a central portion of the tubular housing;

wherein the plurality of fasteners each include a plurality of D-shaped carabiners each having a spring biased latch pivotally affixed to a fastener body;

further comprising a plurality of eyelets affixed to the exterior of the tubular housing;

wherein a fastener of the plurality of fasteners is secured to each of the plurality of eyelets;

wherein an aperture of each of the plurality of eyelets is coaxially aligned;

wherein the plurality of fasteners are disposed at regular intervals along the tubular housing;

wherein the tubular housing includes a rigid material configured to maintain its shape to protect the object within the tubular housing from impact;

wherein the plurality of fasteners are disposed along a length of the tubular housing directly opposite the adjustable strap, such that objects secured to the plurality of fasteners hang freely from the tubular housing when the adjustable strap is secured over a user's shoulder;

wherein the bag is removably securable to the tubular housing via securement straps affixed to a lateral edge of the bag adjacent to the upper end and a lower end of the bag;

wherein the adjustable strap further includes a securement fastener disposed on a terminal end thereof, the securement fastener is configured to selectively disengage the terminal end of the adjustable strap from the tubular housing;

wherein the adjustable strap comprises a buckle thereon;

wherein the buckle is configured to selectively adjust a length of the adjustable strap;

wherein the securement straps include a first portion removably securable to a second portion via complementary fasteners;

further comprising a drawstring disposed through the upper end of the bag about the opening;

wherein the drawstring is configured to selectively move the opening between an open configuration and a closed configuration; and wherein the bag is made of a material permeable to air.

* * * * *